United States Patent [19]

Weyer

[11] Patent Number: 4,950,127

[45] Date of Patent: Aug. 21, 1990

[54] ROTARY DIPPER STICK

[76] Inventor: Paul P. Weyer, 48811-284th Ave., S. E., Enumclaw, Wash. 98022

[21] Appl. No.: 337,749

[22] Filed: Apr. 13, 1989

[51] Int. Cl.[5] ..... E02F 3/75

[52] U.S. Cl. ..... 414/694; 414/705; 414/727

[58] Field of Search ..... 414/694, 697, 695.8, 414/722, 727, 705

[56] References Cited

U.S. PATENT DOCUMENTS

| | | | |
|---|---|---|---|
| 3,343,693 | 9/1967 | Becker | 414/694 |
| 3,871,538 | 3/1975 | Miller et al. | 414/694 X |
| 4,049,139 | 9/1977 | Stedman | 414/694 |
| 4,274,796 | 6/1981 | Phillips | 414/694 X |
| 4,274,797 | 6/1981 | Coon | 414/694 |

OTHER PUBLICATIONS

Helac Corporation, PF5551, "All Around Excavator".

*Primary Examiner*—David A. Bucci
*Assistant Examiner*—James T. Eller Jr.
*Attorney, Agent, or Firm*—Seed and Berry

[57] ABSTRACT

A vehicle having a fluid-powered rotary dipper stick assembly including a boom attachment head and a bucket attachment head with an outer body extending therebetween. A shaft extends longitudinally within the outer body. An inner body is disposed within the outer body immediately inward of the outer body to provide support thereto. In one embodiment, the inner body is rigidly attached to the shaft for rotation as a unit relative to the outer body. In another embodiment, the outer body and the shaft are rigidly attached together for rotation as a unit relative to the inner body. A linear-to-rotary transmission mechanism including a piston sleeve is disposed within the inner and outer bodies and is operable to produce rotational movement of the shaft relative to whichever of the outer or inner bodies is not connected to the shaft. The piston sleeve is operated by the application of pressurized fluid to produce linear movement of the piston sleeve which is translated into rotational movement of the outer body or the shaft, depending on which is connected to the bucket attachment head, and provides rotation of a bucket attached thereto about the body longitudinal axis independent of the boom attachment head.

48 Claims, 4 Drawing Sheets

ROTARY DIPPER STICK

TECHNICAL FIELD

The present invention relates generally to the boom arms or, as they are generally known in the trade, "dipper sticks," which carry a bucket or other work implement used by backhoes and excavators, and more particularly, to a dipper stick which is selectively rotatable about its longitudinal axis.

BACKGROUND OF THE INVENTION

Backhoes, excavators and similar types of vehicles have an articulated arm assembly with a boom arm pivotally connected to the vehicle and a dipper stick pivotally attached to the boom arm at an end remote from the vehicle. The arm assembly usually has a bucket pivotally attached at the free end of the dipper stick. Generally, the articulated arm assembly is pivotally connected to the vehicle so that the arm assembly can be rotated about a vertical axis relative to the vehicle, or is attached to a cab with the cab and arm assembly being rotatable as a unit about a vertical axis relative to the vehicle undercarriage. The bucket is pivotally attached to the dipper stick by a clevis which serves as a pivot point for the bucket relative to the dipper stick. The bucket is rotatable about the dipper stick pivot point in a generally vertical plane containing the boom arm and the dipper stick. While the entire articulated arm assembly can be rotated relative to the vehicle, the dipper stick and attached bucket could not be rotated about the longitudinal axis of the dipper stick. Thus, the dipper stick and attached bucket could not be rotated independent of the boom arm.

There are occasions, however, when it would be very desirable to be able to rotate the dipper stick and hence the bucket independent of the boom arm so that the bucket can work along a cut line out of the plane containing the boom arm and the dipper stick. This would allow an operator to dig an offset ditch, such as a ditch running along a straight cut line at a distance to the side of the vehicle, without moving the vehicle. Of course, when digging such a ditch it is desirable to keep the bucket in alignment with the cut line at all times to provide a ditch having the precise width of the bucket being used. Without being able to rotate the dipper stick about its longitudinal axis, in the past, this meant aligning the vehicle so that the plane containing the boom arm and the dipper stick was in coincidence with the cut line. It was not possible to park the vehicle off to the side of the ditch and spaced away from the cut line, such as is sometimes desirable, and dig a narrow ditch along the cut line.

Being able to rotate the dipper stick also would allow the operator much greater flexibility in the cut being made by the bucket in other situations and minimize the number of vehicle moves necessary to accomplish the cut desired. One example is the digging of a box hole with a square corner where the bucket must dig from two directions at right angles to each other to make a clean corner cut. Another example is digging around piles and other obstacles, or digging several ditches at different angles, such as a main and branch water supply or drainage ditches. It is very desirable to be able to complete such cuts without moving the vehicle. Being able to rotate the dipper stick enables the operator to perform such digging jobs with little or no movement of the vehicle, and also to lift or manipulate objects, such as rocks or slabs from all angles without moving the vehicle. The ability to rotate the dipper stick allows the operator to conveniently perform additional jobs, such as rotating the dipper stick in one direction to pick up material, and then rotating the dipper stick by 180° or as desired and extend the articulated arm to deliver the material to another place.

The increased versatility noted above has been realized with the advent of the rotatable dipper stick. In the past, such rotatable dipper stick units have utilized a dipper stick with a boom attachment head comprising a large turntable bearing with a ring gear machined into the perimeter of the rotatable turntable bearing member. A hydraulic motor with a pinion gear in engagement with the turntable gear provided the rotational drive. A brake was used to stop the rotational movement when desired and to hold the rotational position of the turntable bearing member while the dipper stick was being used to dig. This arrangement is bulky, heavy and lacks precision control both during rotation of the dipper stick and when being held in position while work is being performed. The resulting dipper stick assembly is much larger than a conventional non-rotatable dipper stick and larger than desirable for all but the largest excavation vehicles. Further, such a design arrangement cannot be reduced in size for use in the smaller sized dipper sticks necessary for smaller-sized backhoes and excavators. While such rotatable dipper sticks have existed for several years, the drive mechanisms used have not provided optimum results.

It will therefore be appreciated that there has been a significant need for a rotatable dipper stick rotated by a mechanism able to transmit a large torque to the dipper stick and firmly hold the dipper stick in the desired rotational position even under large work loads. Preferably, the rotatable dipper stick should be rotatable through more than 360°. The rotatable dipper stick should be smaller and lighter than those presently available, and fit within the normal dimensional envelope of presently existing conventional nonrotatable dipper sticks. The rotatable dipper stick should also be effectively and economically manufacturable in small as well as large sizes. Moreover, the rotatable dipper stick should have a precision rotational drive mechanism capable of precise positional control and able to hold its rotational position without the use of a separate brake mechanism which can slip or fail. The rotatable dipper stick should also be able to operate without failure when subjected to large side loads. The present invention fulfills these needs and further provides other related advantages.

DISCLOSURE OF THE INVENTION

The present invention resides in a vehicle having a fluid-powered, rotary dipper stick assembly mounted to a boom arm of the vehicle. The vehicle includes a selectively operable dipper stick actuator associated with the boom arm for rotation of the dipper stick assembly through a boom plane containing the boom arm.

The dipper stick assembly has a work implement, such as a bucket, and a selectively operable work implement actuator associated therewith for pivotal movement of the work implement through a dipper stick plane containing the dipper stick assembly. It is noted that the invention may also be practiced by the manufacture of a dipper stick assembly not including the vehicle, boom arm or dipper stick actuator. Similarly, the invention may be practiced by the manufacture of the dipper stick assembly without the work implement attached thereto. The particular form the invention takes depends upon whether a backhoe, excavator or other type of vehicle using the dipper stick assembly is being sold as original equipment or whether the dipper stick assembly is being sold as a retrofit product for existing vehicles.

The dipper stick assembly of the present invention includes a boom attachment head having a first attachment portion attachable to the vehicle boom arm, and a second attachment portion attachable to the dipper stick actuator to provide pivotal movement of the boom attachment head through the boom plane upon actuation of the dipper stick actuator. In a preferred embodiment of the invention, the first and second attachment portions are selectively detachable from the boom arm and the dipper stick actuator.

The dipper stick assembly further includes a work implement attachment head having a third attachment portion attachable to the work implement to provide pivotal movement of the work implement through the dipper stick plane upon actuation of the work implement actuator. Preferably, the third attachment portion is selectively detachable from the work implement.

An elongated, generally cylindrical body having a longitudinal axis extends at least partially between the boom attachment head and the implement attachment head. The body has a first body end toward the boom attachment head and a second body end toward the work implement attachment head.

A shaft extends longitudinally within the body in general coaxial arrangement with the body. One of the body or the shaft is rigidly attached to the boom attachment head, and the other of the body or shaft is rigidly attached to the work implement attachment head and has a fourth attachment portion spaced away from the work implement attachment head. The fourth attachment portion is attachable to the work implement actuator to supply a counterforce upon actuation of the work implement actuator to rotate the work implement in the dipper stick plane. The body and shaft are selectively rotatable relative to each other about the body longitudinal axis.

The dipper stick assembly further includes linear-to-rotary transmission means disposed within the body and operable for producing relative rotational movement between the shaft and the body. The transmission means includes a piston for the selective application of fluid pressure to one or an other side thereof to produce linear movement of the piston within the body selectively toward the first and second body ends. Means are provided for translating linear movement of the piston toward one of the first or second body ends into clockwise relative rotational movement between the shaft and the body, and translating linear movement of the piston toward the other of the first or second body ends into counterclockwise relative rotational movement between the shaft and the body to selectively rotate the work implement attachment head and hence the work implement about the body longitudinal axis independent of the boom attachment head and hence the boom arm.

In a preferred embodiment of the invention, the body is an outer body, and the assembly includes an elongated, generally cylindrical inner body disposed within the outer body. The inner body has an outward wall portion thereof positioned immediately adjacent to an inward wall portion of the outer body. The inner body further has first and second inner body ends and extends longitudinally within the outer body in generally coaxial arrangement therewith from the first inner body end positioned toward the first outer body end to the second inner body end positioned toward a midportion of the outer body end between the first and second outer body ends. The inner body is in supporting sliding engagement toward both the first and second inner body ends with the inner wall portion of the outer body.

In one embodiment, the inner body is rigidly attached to the shaft toward the inner body end, and the outer body is selectively rotatable relative to the inner body and the shaft about the body longitudinal axis. The assembly further includes a first radial bearing disposed between the inward wall portion of the outer body and the outer wall portion of the inner body toward the first inner body end. Also included is a second radial bearing disposed between the inward wall portion of the outer body and the outward wall portion of the inner body toward the second inner body end. The first and second inner body ends are spaced apart by a sufficient distance to provide increased stability against forces generated during use of the dipper stick assembly tending to move the outer body out of coaxial alignment with the shaft. As such, the dipper stick assembly is capable of handling significantly increased loads without interfering with the operation of the linear-to-rotary transmission such as can occur on misalignment of the outer body and the shaft.

In one embodiment of the invention, the shaft extends between the boom attachment head and the work implement attachment head, and retains them against separation along the body longitudinal axis. The work implement attachment head includes an annular support bracket rigidly attached thereto and having a central aperture through which the shaft extends. The shaft further includes an end cap attached thereto at a longitudinally outward side of the support bracket and sized with a diameter larger than the support bracket central aperture. Thrust and radial bearings are positioned between the end cap and the support bracket so that the end cap retains the work implement attachment head against separation from the boom attachment head while permitting free rotation of the work implement attachment head relative to the shaft. The end cap is threadably received on a threaded end portion of the shaft to provide selective longitudinal adjustability.

In this embodiment of the invention, the linear-to-rotary transmission means includes a ring gear rigidly attached to the outer body and having splines meshing with splines formed on an outward surface portion of a sleeve. Splines formed on an inward surface of the sleeve mesh with splines formed on an outward surface portion of the shaft. The sleeve is in operative engagement with the piston for movement therewith.

In a second embodiment of the invention, the dipper stick assembly includes a tie rod extending longitudinally within the body in generally coaxial arrangement with the shaft and through a central longitudinally extending aperture in the shaft. The tie rod extends fully between the boom attachment head and the work implement attachment head and retains them against separation along the body longitudinal axis. In this embodiment, the shaft extends from the boom attachment head to about the midportion of the outer body.

In a third embodiment of the invention, the body is an inner body, and the dipper stick assembly further includes an elongated, generally cylindrical outer body generally extending longitudinally between the boom attachment head and the work attachment head in generally coaxial arrangement with the inner body. The outer body has a first outer body end toward the boom attachment head and a second outer body end toward the work implement attachment head. The outer body is rigidly attached to the shaft toward the second outer body end, and the outer body and shaft are selectively rotatable as a unit relative to the inner body about the body longitudinal axis.

In all embodiments of the invention, the boom attachment head has a connector portion to which one of the body or the shaft is rigidly attached. The connector portion is spaced sufficiently apart from the first attachment portion to which the boom arm is attached to allow the fourth attachment portion to avoid hitting the boom arm upon operation of the linear-to- C rotary transmission means to produce rotational movement of the shaft relative to the body. With this arrangement, full 360 or greater rotation of the work implement is permitted about the body longitudinal axis, without the fourth attachment portion and the work implement actuator attached thereto contacting the boom arm.

Other features and advantages of the invention will become apparent from the following detailed description, taken in conjunction with the accompanying drawings.

BEST MODE FOR CARRYING OUT THE INVENTION

Figure 1:
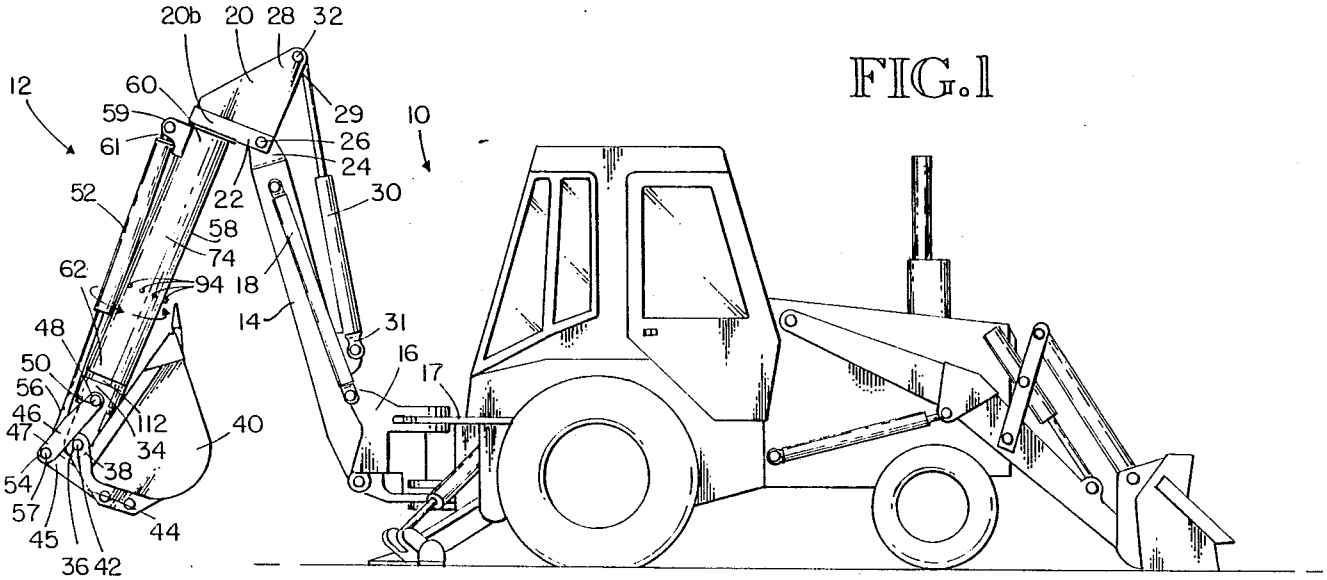
FIG. 1 is a fragmentary, side elevational view of an excavator shown with a rotary dipper stick assembly embodying the present invention.

As shown in the drawings for purposes of illustration, the present invention is embodied in a vehicle, indicated generally by reference numeral 10, having a fluid-powered, rotary dipper stick assembly 12. The vehicle 10 may be a backhoe, as illustrated in FIG. 1, or an excavator or other vehicle that might utilize a rotary dipper stick. As best shown in FIG. 1, the vehicle 10 has a boom arm 14 which is pivotally connected by one end to a base member 16. In the illustrated backhoe, the base member 16 is pivotally connected to a vehicle frame 17 for pivotal rotation about a vertical rotational axis. A pair of hydraulic cylinders 18 (only one being shown in FIG. 1) are provided for raising and lowering the boom arm 14 relative to the base member 16 and pivotal movement of the boom arm through a generally vertical boom plane. Other vehicles, particularly large excavators utilizing the invention, may have an articulated boom arm having two arms pivotally and even laterally rotationally connected together, with the rotary dipper stick assembly 12 attached at the end of the arm remote from the vehicle frame.

The rotary dipper stick assembly 12 includes a boom attachment head 20 having a first clevis 22 by which an attachment end 24 of the boom arm 14 remote from the base member 16 is attached to the boom attachment head using a removable pivot pin 26. The boom attachment head 20 further includes another clevis 28 separated from the first clevis 22 by which an attachment end 29 of a hydraulic cylinder 30 is attached to the boom attachment head using a removable pivot pin 32. An opposite attachment end 31 of the hydraulic cylinder 30 is attached to the boom arm 14. The hydraulic cylinder 30 is selectively operable to pivotally move the boom attachment head 20 through the boom plane upon actuation of the hydraulic cylinder 30. It is to be understood that in situations where the boom arm is comprised of two arms and they are connected together in a manner that allows some lateral rotation between them, the boom plane may be defined as the vertical plane through which the arm remote from the vehicle frame is pivoted.

The rotary dipper stick assembly 12 further includes a bucket attachment head 34 having a first pivot pin aperture 36 by which a clevis 38 of a conventional digging bucket 40 is connected to an end of the bucket attachment head remote from the boom attachment head 20 using a removable pivot pin 42. A rotation link 44 is pivotally connected through an interconnecting link 46 to a second pivot pin aperture 48 of the bucket attachment head 34 using a removable pivot pin 50. A hydraulic cylinder 52 is provided for rotation of the bucket 40 through a dipper stick plane containing the boom attachment head 20 and the bucket attachment head 34 upon actuation of the hydraulic cylinder 52. An end portion 45 of the rotation link 44 and an end portion 47 of the interconnecting link 46 each has a transverse aperture 54 therethrough for connection to an end portion 56 of the hydraulic cylinder 52 using a pivot pin 57. By the use of removable pivot pins, the boom attachment head 20 can be conveniently removed from the boom arm 14, and when manufactured as a retrofit item, the rotary dipper stick assembly 12 can be conveniently attached to a conventional boom arm without modification required. Further, the bucket 40 can be conveniently removed and replaced with a larger-sized bucket or another style of work implement of conventional design.

Figure 2:
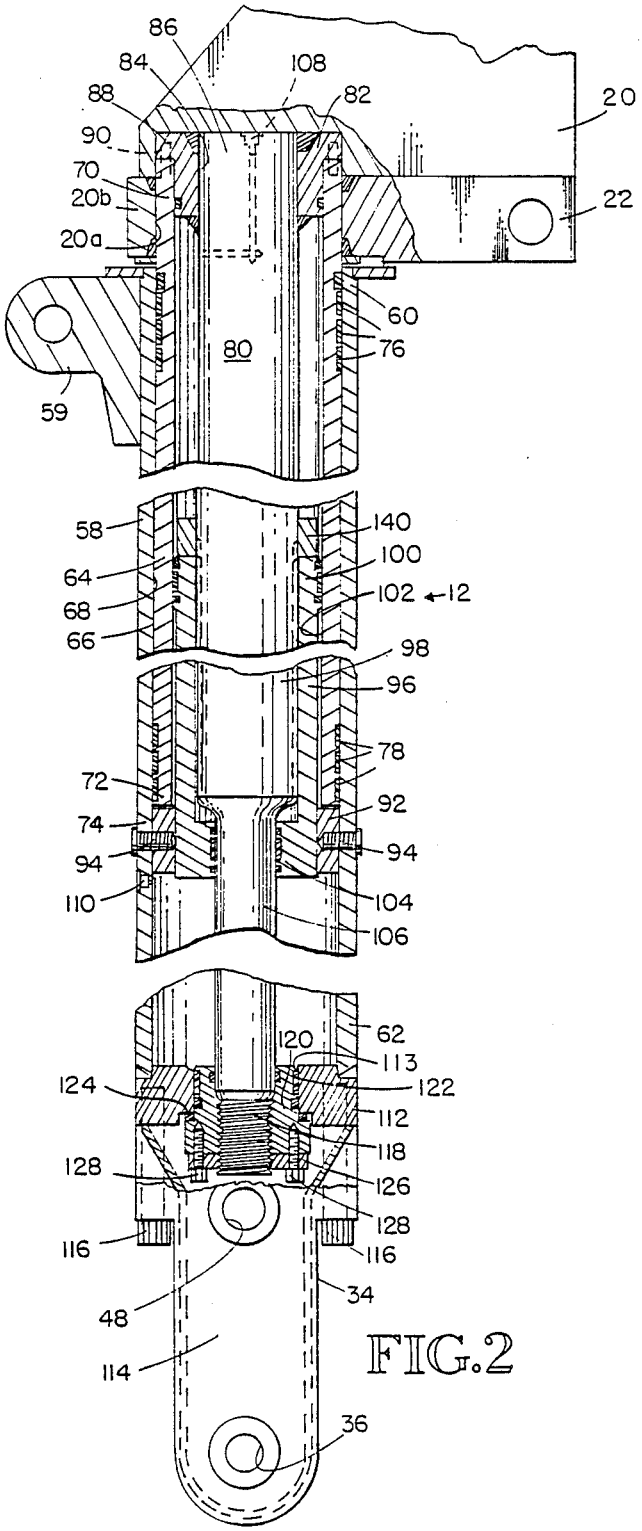
FIG. 2 is an enlarged, fragmentary, side elevational cross-sectional view of the rotary dipper stick assembly of FIG. 1, shown detached from the boom arm of the excavator and with the bucket detached from the rotary dipper stick of FIG. 1.

In the first embodiment of the invention shown in detail in FIG. 2, the rotary dipper stick assembly 12 includes an elongated, generally cylindrical outer body 58 having a longitudinal central axis and extending fully between the boom attachment head 20 and the bucket attachment head 34. The outer body 58 has a first outer body end 60 positioned toward the boom attachment head 20, and a second outer body end 62 positioned toward the bucket attachment head 34. The outer body 58 is rigidly connected to the bucket attachment head 34 at the second outer body end 62. The outer body 58 is rotatable about its longitudinal axis relative to the boom attachment head 20, and rotation of the outer body causes rotation of the bucket attachment head 34 and the bucket 40 about the body longitudinal axis independent of the boom arm 14, as will be described in more detail below.

An elongated, generally cylindrical inner body 64 is disposed within the outer body 58 with an outward wall portion 66 thereof positioned immediately adjacent to an inward wall portion 68 of the outer body and in supporting sliding engagement therewith. The inner body 64 has a first inner body end 70 positioned toward the first outer body end 60, and a second inner body end 72 positioned toward a midportion 74 of the outer body 58 located between the first and second outer body ends 60 and 62. The inner body 64 extends longitudinally within the outer body 58 in a generally coaxial arrangement therewith. The first inner body end 70 extends beyond the first outer body end 60 and is received in an aperture 20*a* in a support block 20*b* of the boom attachment head 20. The inner body 64 is welded to the support block 20*b* at the aperture 20*a*.

A plurality of first radial bearings 76 are disposed between the inward wall portion 68 of the outer body 58 and the outer wall portion 66 of the inner body 64 toward the first outer body end 60. A plurality of second radial bearings 78 are similarly disposed between the inward wall portion 68 of the outer body 58 and the outward wall portion 66 of the inner body 64 toward the second inner body end 72. The first and second inner body ends 70 and 72, and also the location of the first and second radial bearings 76 and 78 are spaced apart by a sufficient distance to provide increased stability to the outer body 58 against forces such as the large side load which may be generated during use of the dipper stick assembly 12 and tend to move the outer body out of its proper alignment.

A clevis 59 is rigidly attached to an outward wall portion of the outer body 58 at the first outer body end 60 so as to be spaced away from the bucket attachment head 34 for attachment thereto of an attachment end 61 of the hydraulic cylinder 52. The clevis 59 supplies a counterforce upon actuation of the hydraulic cylinder 52 to pivotally move the bucket 40 through the dipper stick plane.

A shaft 80 extends longitudinally within the outer and inner bodies 58 and 64 in generally coaxial arrangement therewith. The inner body 64 is rigidly attached to the shaft 80 at the first inner body end 70 by an annular end cap 82. The end cap 82 has a central aperture 84 into which an end portion 86 of the shaft projects and the shaft is welded to the end cap at the aperture 84. The end cap 82 has a circumferential flange portion 88 which projects radially outward coextensive with the inner body 64 and is rigidly attached thereto at the first inner body end 70 by a plurality of fasteners 90. As such, the outer body 58 with the bucket attachment head 34 rigidly attached thereto is selectively rotatable about the body longitudinal axis relative to the inner body 64 and the shaft 80 which are rigidly attached together and to the boom attachment head 20. This ability to rotate the outer body 58 and bucket 40 independent of the boom arm 14 increases the versatility of the vehicle 10 compared to conventional nonrotatable dipper stick assemblies.

The rotational movement of the outer body 58 relative to the shaft 80, and hence to the inner body 64, is accomplished using a linear-to-rotary transmission arrangement disposed within the outer and inner bodies 58 and 64. The linear-to-rotary transmission arrangement shown in FIG. 2 includes a ring gear 92 disposed within the outer body 58 and rigidly attached thereto by a plurality of pins 94, and an elongated piston sleeve 96 reciprocally disposed within the outer and inner bodies 58 and 64 and extending longitudinally therewithin in generally coaxial arrangement therewith. The piston sleeve 96 coaxially receives the shaft 80. The ring gear 92 is attached to the outer body midportion 74 longitudinally outward of the second inner body end 72. The ring gear 92 has inner helical splines meshing with corresponding outer helical splines which extend over a portion of the length of the piston sleeve 96. The piston sleeve 96 also has inner helical splines which extend over a portion of the length thereof and mesh with corresponding helical splines which extend over a midportion 98 of the shaft 80. Reciprocation of the piston sleeve 96 causes rotation of the outer body 58 relative to the shaft 80 in a conventional manner for fluid-powered helical actuators.

The piston sleeve 96 has an annular outer piston head 100 at an end of the piston sleeve toward the first inner body end 70 with conventional seals to provide a fluid-tight seal between the outer piston head and a smooth inward wall portion 102 of the inner body 64. The piston sleeve 96 further has an annular inner piston head 104 at an end of the piston head toward the second outer body end 62 with conventional seals to provide a fluid-tight seal between the inner piston head and a smooth outer surface portion 106 of the shaft 80. The piston sleeve 96 is slidably retained within the outer and inner bodies 58 and 64 for reciprocal movement therewithin in response to the application of hydraulic fluid to one or the other longitudinal sides of the piston heads 100 and 104, as will be described below.

Reciprocation of the piston sleeve 96 occurs when hydraulic fluid under pressure enters a port 108 to a first side of the piston heads 100 and 104, or a second port 110 to the other side of the piston heads. Conventional seals are provided between the other components to define a fluid-tight compartment to each side of the piston heads 100 and 104, with each of the ports 108 and 110 in fluid communication with one of the compartments. As the piston sleeve 96 linearly reciprocates along the longitudinal body axis, the meshing of the splines of the piston sleeve with the corresponding splines of the ring gear 92 and the shaft 80 cause the outer body 58 to rotate relative to the shaft. Fluid pressure applied to either side of the piston heads 100 and 104 causes the piston sleeve 96 to move linearly and rotate as a result of the inner splines of the piston sleeve meshing with the splines of the shaft 80. This linear and rotational movement of the piston sleeve 96 is transmitted through the outer splines of the piston sleeve to the outer body 58 through the splines of the ring gear 92. Since the shaft 80 is held stationary with respect to the boom attachment head 20, rotation of the outer body 58, and hence the bucket attachment head 34 and the bucket 40 attached thereto, results. Depending on the slope and direction of turn of the various helical splines chosen, there may be provided a multiplication or reduction of the relative rotation between the outer body 58 and the shaft 80 and a desired torque.

Since side loads and other forces encountered during use of the rotary dipper stick assembly 12 to dig can cause misalignment of the splines of the ring gear 92, the piston sleeve 96 and the shaft 80, it is important to maintain the proper coaxial alignment of the outer body 58 and the shaft. This is facilitated by the use of the inner body 64 slidably supporting the outer body 58. With this arrangement, the dipper stick assembly 12 has the capability of handling significantly increased side loads without interfering with the operating of the linear-to-rotary transmission arrangement that can occur if the outer body 58 should become misaligned with the shaft 80.

With the rotary dipper stick assembly 12 of the present invention, a rotary dipper stick can be manufactured in a variety of sizes fitting within the normal dimensional envelope of presently existing conventional non-rotatable dipper sticks. Further, the rotary dipper stick assembly 12 incorporates as an integral part of its design a fluid-powered actuator which requires far less space and is lighter than the rotatable dipper sticks presently on the market which use a ring gear machined into a rotatable turntable bearing member, a hydraulic motor with a pinion gear to engage the ring gear and drive the turntable, and a separate brake to stop the rotational movement of the turntable when desired and hold the rotational position of the turntable when the dipper stick is being used dig.

The fluid-powered actuator design incorporated into the rotary dipper stick assembly 12 of the present invention provides the benefits of a high-torque and high-efficiency fluid-powered device using a simple linear piston and cylinder drive arrangement. Thus, high torque can be achieved from a relatively small mechanism, and precision positional control is achieved without the need for a separate brake mechanism. Once the outer body 58 and the bucket 40 attached thereto have been rotated to a desired rotational position, fluid is applied to both ports 108 and 110 to hold the piston sleeve 96 stationary within the inner and outer bodies 58 and 64 and unable to move in either longitudinal direction. This also holds the shaft 80 and the outer body 58 stationary relative to each other, and hence the bucket 40 is held firmly locked against undesirable rotation about the body longitudinal axis while the bucket is being used to dig. The present invention avoids the necessity for a separate brake mechanism which can slip or fail. The precise control is achieved by simply metering the fluid applied to the piston heads 100 and 104.

The illustrated embodiment of the rotary dipper assembly 12 shown in FIG. 2 produces 110,000 inch-pounds of torque when operated using fluid at 3,000 pounds per square inch. In this embodiment the outer body 58 and the bucket 40 are rotatable through 450..

In the embodiment of the dipper stick assembly shown in FIG. 2, the shaft extends fully between the bucket attachment head 34 and the boom attachment head 20 to which it is rigidly attached. In addition to its use as part of the linear-to-rotary transmission arrangement, the shaft 80 serves to retain the boom attachment head 20 and the bucket attachment head 34 against separation along the body longitudinal axis. This is accomplished by manufacturing the bucket attachment head 34 with an annular support bracket 112 which is welded to the outer body 58 at the second outer body end 62, and with a detachable bucket support 114 which has the first and second pivot pin apertures 36 and 48 formed therein. The bucket support 114 is attached to the support bracket 112 by a plurality of bolts 116. The support bracket 112 is provided with a central aperture 113 through which a threaded end portion 118 of the shaft 80 extends. An interiorly threaded end cap 120 is threadably received on the shaft threaded end portion 118 at a longitudinally outward side of the support bracket 112 and is sized with a diameter larger than the central aperture 113 of the support bracket. A radial bearing 122 and a thrust bearing 124 are positioned between the end cap 120 and the support bracket 112 to permit free rotation of the shaft 80 relative to the support bracket 112, and hence the outer body 58 and the bucket 40, while retaining the bucket attachment head 34 against separation from the boom attachment head 20 along the body longitudinal axis.

By selectively adjusting the position of the end cap 120 on the shaft threaded end portion 118, the longitudinal force the end cap applies on the support bracket 112 toward the first outer body end 60 to retain the bucket attachment head against separation from the boom attachment head 20, can be selected. A threaded lock nut 126 is threadably received on the shaft threaded end portion 118 and has a plurality of smooth bore apertures. Corresponding positioned threaded apertures are provided in the end cap 120. Lock bolts 128 extend through the smooth bores of the lock nut 126 and into the threaded bores of the end cap 120, and when tightened serve to lock the end cap against rotation during use of the rotary dipper stick assembly 12.

A stop ring 140 is provided to engage and limit the axial travel of the outer piston head 100 toward the first inner body end 60. The stop ring 140 is welded to the shaft 80.

To permit the unimpeded rotation of the outer body 58 about the body longitudinal axis, the support block **20*b* projects outwardly away from the first clevis 22 at which the boom arm 14 is attached by a sufficient distance to avoid the clevis 59 as it rotates With the outer body 58. This permits uninhibited 360° rotation of the outer body 58. It is noted that by selecting the outer body 58 to be rotatable and the shaft 80 to be rigidly attached to the boom attachment head 20, spacing the outer body, and hence the clevis 59 attached thereto, away from the boom arm 14 was facilitated. In an alternative embodiment not shown, the outer body 58 is rigidly connected to the boom attachment head 20, and the clevis 59 is attached to an upper end of the shaft 80 projecting beyond the stationary outer body. With this arrangement, it is very difficult to make the attachment between the boom attachment head 20 and the outer body 58 without interfering with and limiting the free rotation of the shaft 80 as a result of the clevis 59** contacting the boom attachment head.

Figure 3:
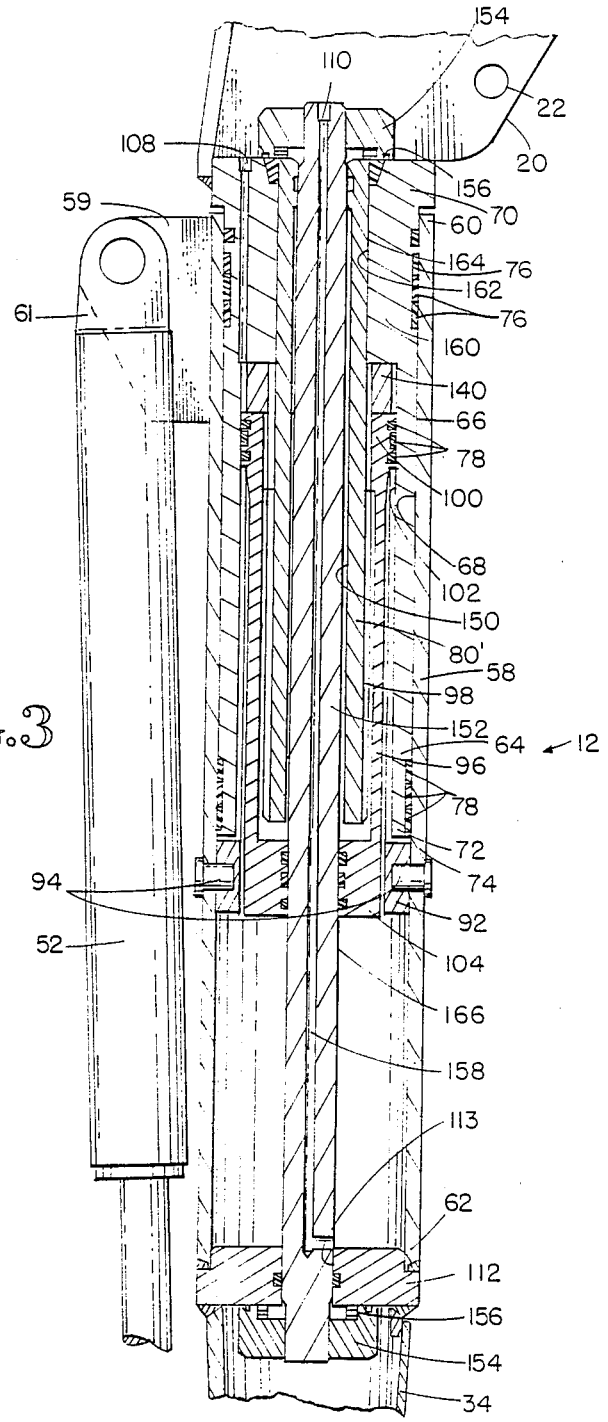
FIG. 3 is a fragmentary, side elevational cross-sectional view of an alternative embodiment of the rotary dipper stick.

A second embodiment of the dipper stick assembly 12 very similar to the assembly of FIG. 1, is shown in FIG. 3. For ease of understanding, the components of the alternative embodiments of the invention described below will be similarly numbered with those of the first embodiment when of a similar construction. Only the more significant differences in construction will be described in detail.

One such difference in the embodiment of FIG. 3 is the use of a shaft 80' having a longitudinally extending central through-bore 150. The shaft 80' extends from the boom attachment head 20, where it is welded directly to the inner body 64, to about the midportion 74 of the outer body 58. Extending within the through-bore 150 of shaft 80' is a tie rod 152 which extends fully between the boom attachment head 20 and the bucket attachment head 34 to retain them together against separation along the body longitudinal axis, much as does the shaft 80 in the first embodiment shown in FIG. 2. The tie rod 152 extends outward beyond both the inner body 64 at the first inner body end 70, and the support bracket 112 at the second outer body end 62. A lock member 154 is threadably attached to each end of the tie rod 152 longitudinally outward of the inner body 64 and the support bracket 112 to lock the boom attachment head 20 and the bucket attachment head 34 against separation. Each lock member 154 includes a thrust bearing 156 to permit the free rotation of the tie rod 152 relative to the outer body 58, the inner body 64 and the shaft 80'.

A central aperture 158 in the tie rod 152 extending nearly its full length leads from the port 110 to the fluid-tight compartment toward the second outer body end 62 to conduct fluid thereto.

In this second embodiment of the invention, the inner body 64 has an elongated spacer portion 160 toward the first inner body end 70 through which the shaft 80' extends. The spacer portion 160 has a wall thickness to provide an inner wall portion 162 positioned immediately adjacent an outward wall portion 164 of the shaft 80'. The spacer portion 160 extends longitudinally within the inner body 64 along a sufficient lengthwise portion of the shaft 80' to provide increased stability against forces generated during use of the dipper stick assembly 12 tending to move the outer body 58 out of coaxial alignment with the shaft.

Since a shorter shaft 80' is used, the inner piston head 104 provides a seal with a smooth outer surface portion 166 of the tie rod 152, not the shaft.

Figure 4:
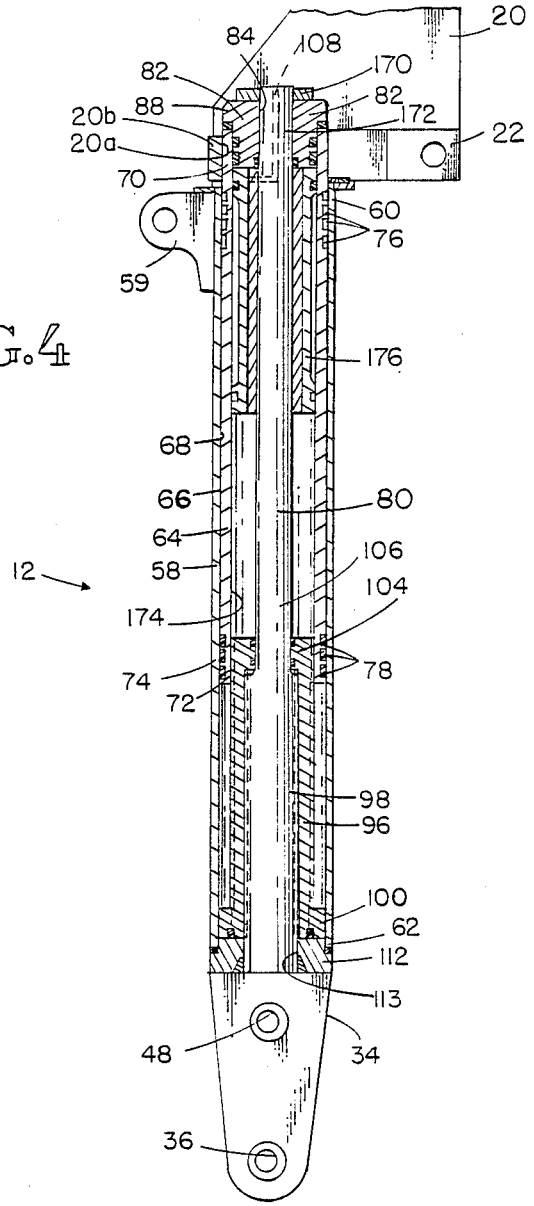
FIG. 4, is a fragmentary, side elevational cross-sectional view of a second alternative embodiment of the rotary dipper stick of FIG. 1.

A third embodiment of the invention is shown in FIG. 4. Unlike with the first and second embodiments previously described, in this third embodiment, the shaft 80 is rigidly attached to the outer body 58, not to the inner body 64, and the inner body rotates relative to the shaft and the outer body. The attachment of t he shaft 80 to the outer body 58 is accomplished at the second outer body end 62 by welding the shaft to the end cap 112. In this embodiment, the end cap 82 at the first inner body end 70 is not rigidly attached to the inner body 64 as it was in the first embodiment shown in FIG. 2. Instead, an arrangement similar to the end cap 120 at the second outer body end 62 of the first embodiment is utilized. Both thrust and radial bearings are disposed between the end cap 82 and the inner body 64 at the first inner body end 70 to permit free rotation of the shaft 80 relative to the inner body. A lock nut 170 is threadably received on a threaded end portion 172 of the shaft 80 to lock the end cap 82 against rotation during fluid-powered operation of the dipper stick assembly 12.

Another difference in the third embodiment which results from the rigid attachment of the shaft 80 to the outer body 58, is the need to transmit torque between the piston sleeve 96 and the inner body 64, rather than the outer body. As such, the ring gear 92 of the first embodiment shown in FIG. 2 has been eliminated, and an inward surface portion 174 of the inner body 64 toward the first inner body end 72 is provided with splines extending over a lengthwise portion thereof for engagement with the outer splines of the piston sleeve 96. The piston sleeve 96 transmits torque between the shaft 80 and the inner body 64, and the rotational drive to the bucket attachment head 34 is provided by the shaft 80' not the outer body 58 as in the first embodiment of FIG. 2.

In this third embodiment, the outer piston head 100 is disposed within the outer body 58 toward the second outer body end, rather than the inner body 64. It is noted that the inner piston head 104 still provides a seal against the shaft 80. A stop tube 176 is provided to limit longitudinal travel of the piston sleeve 96 toward the first inner body end 70.

It will be appreciated, that although specific embodiments of the invention have been described herein for purposes of illustration, various modifications may be made without departing from the spirit and scope of the invention. Accordingly, the invention is not limited except as by the appended claims.

I claim:

1. A fluid-powered, rotary dipper stick assembly, usable with a vehicle having a boom arm and a selectively operable dipper stick actuator associated therewith for pivotal movement of the dipper stick assembly through a boom plane containing the boom arm, the dipper stick assembly being usable with a work implement such as a bucket having a selectively operable work implement actuator associated therewith for pivotal movement of the work implement through a dipper stick plane containing the dipper stick assembly, the dipper stick assembly comprising:

a boom attachment head having a first attachment portion attachable to the vehicle boom arm, and a second attachment portion attachable to the dipper stick actuator to provide pivotal movement of said boom attachment head through the boom plane upon actuation of the dipper stick actuator, said first attachment portion and said second attachment portion being selectively detachable from the boom arm and the dipper stick actuator;

a work implement attachment head having a third attachment portion attachable to the work implement to provide pivotal movement of the work implement through the dipper stick plane upon actuation of the work implement actuator, said third attachment portion being selectively detachable from the work implement;

an elongated, generally cylindrical outer body having a longitudinal axis and generally extending at least partially between said boom attachment head and said work implement attachment head, with a first outer body end toward said boom attachment head and a second outer body end toward said work implement attachment head;

a shaft extending longitudinally within said outer body in general coaxial arrangement with said outer body, said shaft being rigidly attached to said boom attachment head, and said outer body being rigidly attached to said work implement attachment head and having a fourth attachment portion spaced away from said work implement attachment head and attachable to the work implement actuator to apply a counterforce upon actuation of the work implement actuator to rotate the work implement in the dipper stick plane, said outer body and said shaft being selectively rotatable relative to each other about said body longitudinal axis;

an elongated, generally cylindrical inner body disposed within said outer body with an outward wall portion thereof positioned immediately adjacent to an inward wall portion of said outer body, said inner body having first and second inner body ends and extending longitudinally within said outer body in generally coaxial arrangement therewith from said first inner body end positioned toward said first outer body end to said second inner body end positioned toward a midportion of said outer body between said first and second outer body ends, said inner body being rigidly attached to said shaft toward said first inner body end, said outer body being selectively rotatable relative to said inner body and said shaft about said body longitudinal axis, at least said outward wall portion of said inner body toward said first inner body end being in engagement with said inward wall portion of said outer body and at least said outward wall portion of said inner body toward said second inner body end being in engagement with said inward wall portion of said outer body, said first and second inner body ends being spaced apart by a sufficient distance to provide increased stability against forces generated during use of the dipper stick assembly tending to move said outer body out of coaxial alignment with said shaft; and linear-to-rotary transmission means disposed within said outer body and operable for producing rotational movement of said shaft relative to said outer body, said transmission means including a piston for the selective application of fluid pressure to one or an other side thereof to produce linear movement of said piston within said outer body selectively toward said first and second outer body ends, and means for translating linear movement of said piston toward one of said first or second outer body ends into clockwise relative rotational movement between said shaft and said outer body and translating linear movement of said piston toward the other of said first or second outer body ends into counterclockwise relative rotational movement between said shaft and said outer body to selectively rotate said work implement attachment head and hence the work implement about said body longitudinal axis independent of said boom attachment head and hence the boom arm, whereby the dipper stick assembly is capable of handling significantly increased loads without interfering with the operation of said linear-to-rotary transmission means such as can occur on misalignment.

2. The rotary dipper stick assembly of claim 1, wherein said piston is positioned for reciprocal movement within said inner body and the dipper stick assembly includes an outer seal positioned to seal between said piston and an inward wall portion of said inner body and defines a fluid-tight compartment at least partially within said inner body to each side of said piston.

3. The rotary dipper stick assembly of claim 2 wherein said piston is an annular piston having a central aperture through which said shaft extends, and the dipper stick assembly further includes an inner seal positioned to seal between said piston and an outward smooth wall portion of said shaft and define said fluid-tight compartments.

4. The rotary dipper stick assembly of claim 1 wherein said shaft extends between said boom attachment head and said work implement attachment head, and retains said boom attachment head and said work implement head against separation along said body longitudinal axis.

5. The rotary dipper stick assembly of claim 1 wherein said shaft extends between said boom attachment head and said work implement attachment head, and wherein said inner body and said shaft are rigidly attached to said boom attachment head and rotate as a unit with said boom attachment head through the boom plane upon actuation of the dipper stick actuator, and said outer body is rigidly attached to said work implement attachment head and rotates with said work implement attachment head through the dipper stick plane upon actuation of the work implement actuator, said outer body applying rotational drive to said work implement attachment head for selective rotation thereof in clockwise and counterclockwise directions about said body longitudinal axis independent of said boom attachment head upon selective application of fluid pressure to one or an other side of said piston.

6. The rotary dipper stick assembly of claim 5 wherein said fourth attachment portion is rigidly attached to an outward wall portion of said outer body toward said first outer body end and attachable to the work implement actuator.

7. The rotary dipper stick assembly of claim 6 wherein said work implement attachment head includes an annular support bracket rigidly attached thereto and having a central aperture through which said shaft extends, and wherein said shaft further includes an end cap attached thereto at a longitudinally outward side of said support bracket and sized with a diameter larger than said support bracket central aperture, and the dipper stick assembly further includes thrust and radial bearings positioned between said end cap and said support bracket, said end cap retaining said work implement attachment head against separation from said boom attachment head along said body longitudinal axis while permitting free rotation of said work implement attachment head relative to said shaft.

8. The rotary dipper stick assembly of claim 7 wherein said end cap is threadably received on a correspondingly threaded end portion of said shaft extending to said longitudinally outward side of said support bracket, said end cap being selectively longitudinally adjustable on said shaft threaded end portion to adjust the longitudinal force said end cap applies on said support bracket toward said first body end to retain said work implement attachment head against separation from said boom attachment head.

9. The rotary dipper stick assembly of claim 5 wherein said linear-to-rotary transmission means includes a ring gear with a splined inward surface disposed within said outer body toward said second outer body end beyond said second inner body end, said ring gear being rigidly attached to said outer body during fluid-powered operation of the dipper stick assembly, and further includes a sleeve extending through said ring gear and having a correspondingly splined outward surface portion meshing with said ring gear splined inward surface, said sleeve being in operative engagement with said piston for movement therewith.

10. The rotary dipper stick assembly of claim 9 wherein said ring gear splined inward surface and said sleeve splined outward surface portion have meshing helical splines.

11. The rotary dipper stick assembly of claim 9 wherein said sleeve has a central aperture through which said shaft extends, said sleeve having a splined inward surface portion and said shaft having a correspondingly splined outward surface portion meshing with said sleeve splined inward surface portion.

12. The rotary dipper stick assembly of claim 11 wherein said sleeve splined inward surface portion and said shaft splined outward surface portion have meshing helical splines.

13. The rotary dipper stick assembly of claim 5, further including a stop ring having a central aperture through which said shaft extends, said stop ring being positioned toward said first inner body end to limit longitudinal travel of said piston toward said first inner body end.

14. The rotary dipper stick assembly of claim 1 wherein said shaft has a central aperture extending longitudinally therethrough, and the dipper stick assembly further includes a tie rod extending longitudinally within said outer body in generally coaxial arrangement with said shaft and through said shaft central aperture, said tie rod extending between said boom attachment head and said work implement attachment head and retaining said boom attachment head and said work implement attachment head against separation along said body longitudinal axis.

15. The rotary dipper stick assembly of claim 14 wherein said shaft extends from said boom attachment head to about said midportion of said outer body between said first and second outer body ends, and wherein said inner body and said shaft are rigidly attached to said boom attachment head and rotate as a unit with said boom attachment head through the boom plane upon actuation of the dipper stick actuator, and said outer body is rigidly attached to said work implement attachment head and rotates with said work implement attachment head through the dipper stick plane upon actuation of the work implement actuator, said outer body applying rotational drive to said work implement attachment head for selective rotation thereof in clockwise and counterclockwise directions about said body longitudinal axis independent of said boom attachment head upon selective application of fluid pressure to one or an other side of said piston.

16. The rotary dipper stick assembly of claim 15 wherein said fourth attachment portion is rigidly attached to an outward wall portion of said outer body toward said first outer body end and attachable to the work implement actuator.

17. The rotary dipper stick assembly of claim 15 wherein said work implement attachment head includes an annular support bracket rigidly attached thereto and having a central aperture through which said tie rod extends, and wherein said tie rod further includes an end cap attached thereto at a longitudinally outward side of said support bracket and sized with a diameter larger than said support bracket central aperture, said end cap retaining said work implement attachment head against separation from said boom attachment head along said body longitudinal axis while permitting free rotation of said work implement attachment head relative to said shaft.

18. The rotary dipper stick assembly of claim 17 wherein said end cap is threadably received on a correspondingly threaded end portion of said tie rod extending to said longitudinally outward side of said support bracket, said end cap being selectively longitudinally adjustable on said shaft threaded end portion to adjust the longitudinal force said end cap applies on said support bracket toward said first body end to retain said work implement attachment head against separation from said boom attachment head.

19. The rotary dipper stick assembly of claim 15 wherein said linear-to-rotary transmission means includes a ring gear with a splined inward surface disposed within said outer body toward said second outer body end beyond said second inner body end, said ring gear being rigidly attached to said outer body during fluid-powered operation of the dipper stick assembly, and further includes a sleeve extending through said ring gear and having a correspondingly splined outward surface portion meshing with said ring gear splined inward surface, said sleeve being in operative engagement with said piston for movement therewith.

20. The rotary dipper stick assembly of claim 19 wherein said ring gear splined inward surface and said sleeve splined outward surface portion have meshing helical splines.

21. The rotary dipper stick assembly of claim 19 wherein said sleeve has a central aperture through which said shaft extends, said sleeve having a splined inward surface portion and said shaft having a correspondingly splined outward surface portion meshing with said sleeve splined inward surface portion.

22. The rotary dipper stick assembly of claim 21 wherein said sleeve splined inward surface portion and said shaft splined outward surface portion have meshing helical splines.

23. The rotary dipper stick assembly of claim 15 wherein said inner body has an elongated spacer portion having a central aperture through which said shaft extends, said spacer portion being positioned toward said first inner body end, and having a wall thickness to provide an inward wall portion positioned immediately adjacent to an outward wall portion of said shaft, said spacer portion extending longitudinally within said inner body along a sufficient lengthwise portion of said shaft to provide increased stability against forces generated during use of the dipper stick assembly tending to move said outer body out of coaxial alignment with said shaft.

24. The rotary dipper stick assembly of claim 1 wherein said boom attachment head has a connector portion to which one of said body or said shaft is rigidly attached, said connector portion being spaced sufficient apart from said first attachment portion to allow said fourth attachment portion to avoid hitting the boom arm upon operation of said linear-to-rotary transmission means to product rotational movement of said shaft relative to said body, whereby full 360° or greater rotation of the work implement is permitted about the body longitudinal axis, without said fourth attachment portion and the work implement actuator attached thereto contacting the boom arm.

25. A fluid-powered, rotary dipper stick assembly, usable with a vehicle having a boom arm and a selectively operable dipper stick actuator associated therewith for pivotal movement of the dipper stick assembly through a boom plane containing the boom arm, the dipper stick assembly being usable with a work implement such as a bucket having a selectively operable work implement actuator associated therewith for pivotal movement of the work implement through a dipper stick plane containing the dipper stick assembly, the dipper stick assembly comprising:

a boom attachment head having a first attachment portion attachable to the vehicle boom arm, and a second attachment portion attachable to the dipper stick actuator to provide pivotal movement of said boom attachment head through the boom plane upon actuation of the dipper stick actuator;

a work implement attachment head having a third attachment portion attachable to the work implement to provide pivotal movement of the work implement through the dipper stick plane upon actuation of the work imp/element actuator;

an elongated, generally cylindrical outer body having a longitudinal axis and generally extending substantially fully between said boom attachment head and said work implement attachment head, with a first outer body end toward said boom attachment head and a second outer body end toward said work implement attachment head, said outer body being rigidly attached to said work implement attachment head and applying rotational drive thereto, said outer body having a fourth attachment portion rigidly attached to an outward wall portion of said outer body toward said first outer body end spaced away from said work implement attachment head and attachable to the work implement actuator to apply a counterforce upon actuation of the work implement actuator to rotate the work implement in the dipper stick plane;

an elongated, generally cylindrical inner body disposed within said outer body with an outward wall portion thereof positioned immediately adjacent to an inward wall portion of said outer body, said inner body having first and second inner body ends and extending longitudinally within said outer body in generally coaxial arrangement therewith from said first inner body end positioned toward said first outer body end to said second inner body end positioned toward a midportion of said outer body between said first and second outer body ends;

a shaft extending longitudinally within said outer and inner bodies in general coaxial arrangement with said outer and inner bodies, said first and second inner body ends being spaced apart by a sufficient distance to provide increased stability against forces generated during use of the dipper stick assembly tending to move said outer body out of coaxial alignment with said shaft, said shaft and said inner body being rigidly attached together toward said first inner body end and being rigidly attached to said boom attachment head, said outer body being selectively rotatable relative to said shaft and inner body about said body longitudinal axis; and linear-to-rotary transmission means disposed within said outer and inner bodies and operable for producing rotational movement of said outer body relative to said shaft and inner body, said transmission means including a piston for the selective application of fluid pressure to one or another side thereof to produce linear movement of said piston within one of said inner and outer bodies selectively toward said first and second outer body ends, and means for translating linear movement of said piston toward one of said first or second outer body ends into clockwise relative rotational movement between said outer body and said shaft and inner body, and translating linear movement of said piston toward the other of said first or second outer body ends into counterclockwise relative rotational movement between said outer body and said shaft and inner body to selectively rotate said work implement attachment head and hence the work implement about said body longitudinal axis independent of said boom attachment head and hence the boom arm.

26. The rotary dipper stick assembly of claim 25, further including a first radial bearing disposed between said inward wall portion of said outer body and said outward wall portion of said inner body toward said first inner body end, and a second radial bearing disposed between said inward wall portion of said outer body and said outward wall portion of said inner body toward said second inner body end.

27. The rotary dipper stick assembly of claim 25 wherein said piston is positioned for reciprocal movement within said inner body and the dipper stick assembly includes an outer seal positioned to seal between said piston and an inward wall portion of said inner body and defines a fluid-tight compartment at least partially within said inner body to each side of said piston.

28. The rotary dipper stick assembly of claim 25 wherein said shaft extends between said boom attachment head and said work implement attachment head, and retains said boom attachment head and said work implement head against separation along said body longitudinal axis.

29. The rotary dipper stick assembly of claim 28 wherein said work implement attachment head includes a support position rigidly attached thereto, and wherein said shaft further includes retaining means for engaging said support portion and retaining said work implement attachment head against separation from said boom attachment head along said body longitudinal axis while permitting free rotation of said work implement attachment head relative to said shaft.

30. The rotary dipper stick assembly of claim 29 wherein said retaining means is further selectively adjustable to adjust the longitudinal force said shaft applies on said support portion in a direction toward said first body end to retain said work implement attachment head against separation from said boom attachment head.

31. The rotary dipper stick assembly of claim 28, further including a stop ring having a central aperture through which said shaft extends, said stop ring being positioned toward said first inner body end to limit longitudinal travel of said piston toward said first inner body end.

32. The rotary dipper stick assembly of claim 25 wherein said shaft has a central aperture extending longitudinally therethrough, and the dipper stick assembly further includes a tie rod extending longitudinally within said outer and inner bodies in generally coaxial arrangement with said shaft and through said shaft central aperture, said tie rod extending between said boom attachment head and said work implement attachment head and retaining said boom attachment head and said work implement attachment head against separation along said body longitudinal axis.

33. The rotary dipper stick assembly of claim 32 wherein said shaft extends from said boom attachment head to about said midportion of said outer body between said first and second outer body ends.

34. The rotary dipper stick assembly of claim 32 wherein said work implement attachment head includes a support portion rigidly attached thereto and engaging an end portion of said tie rod, and wherein said tie rod further includes retaining means for retaining said work implement attachment head against separation from said boom attachment head along said body longitudinal axis while permitting free rotation of said work implement attachment head relative to said shaft.

35. The rotary dipper stick assembly of claim 34 wherein said retaining means is further selectively adjustable to adjust the longitudinal force said shaft applies on said support portion in a direction toward said first body end to retain said work implement attachment head against separation from said boom attachment head.

36. The rotary dipper stick assembly of claim 32 wherein said inner body has an elongated spacer portion having a central aperture through which said shaft extends, said spacer portion being positioned toward said first inner body end, and having a wall thickness to provide an inward wall portion positioned immediately adjacent to an outward wall portion of said shaft, said spacer portion extending longitudinally within said inner body along a sufficient lengthwise portion of said shaft to provide increased stability against forces generated during use of the dipper stick assembly tending to move said outer body out of coaxial alignment with said shaft.

37. A vehicle usable for excavation, the vehicle comprising:

a vehicle frame;

a boom arm pivotally connected to said vehicle frame and movable through a first plane containing said boom arm;

a dipper stick actuator associated with said boom arm and selectively operable to pivotally move said boom arm through said first plane;

a work implement;

a work implement actuator associated with said work implement and selectively operable to pivotally move said work implement through a second plane;

a boom attachment head having a first attachment portion attachable to the vehicle boom arm, and a second attachment portion attachable to the dipper stick actuator to provide pivotal movement of said boom attachment head through the boom plane upon actuation of the dipper stick actuator, said first attachment portion and said second attachment portion being selectively detachable from the boom arm and the dipper stick actuator;

a work implement attachment head having a third attachment portion attachable to the work implement to provide pivotal movement of the work implement through the dipper stick plane upon actuation of the work implement actuator, said third attachment portion being selectively detachable from the work implement;

an elongated, generally cylindrical outer body having a longitudinal axis and generally extending at least partially between said boom attachment head and said work implement attachment head with a first outer body end toward said boom attachment head and a second outer body end toward said work implement attachment head;

a shaft extending longitudinally within said outer body in general coaxial arrangement with said outer body, said shaft being rigidly attached to said boom attachment head, and said outer body being rigidly attached to said work implement attached head and having a fourth attachment portion spaced away from said work implement attachment head and attachable to the work implement actuator to apply a counterforce upon actuation of the work implement actuator to rotate the work implement in the dipper stick plane, said outer body and said shaft being selectively rotatable relative to each other about said outer body longitudinal axis;

an elongated generally cylindrical inner body disposed within said outer body with an outward wall portion thereof positioned immediately adjacent to an inward wall portion of said outer body, said inner body having first and second inner body ends and extending longitudinally within said outer body in generally coaxial arrangement therewith from said first inner body end positioned toward said first outer body end to said second inner body end positioned toward a midportion of said outer body between said first and second outer body ends, said inner body being in supporting sliding engagement toward both said first and second inner body ends with said inward wall portion of said outer body, said inner body being rigidly attached to said shaft toward said first inner body end, said outer body being selectively rotatable relative to said inner body and said shaft about said body longitudinal axis, said first and second inner body ends being spaced apart by a sufficient distance to provide increased stability against forces generated during use of the dipper stick assembly tending to move said outer body out of coaxial alignment with said shaft; and linear-to-rotary transmission means disposed within said outer body and operable for producing rotational movement of said shaft relative to said outer body, said transmission means including a piston for the selective application of fluid pressure to one or an other side thereof to produce linear movement of said piston within said outer body selectively toward said first and second outer body ends, and means for translating linear movement of said piston toward one of said first or second outer body ends into clockwise relative rotational movement between said shaft and aid outer body and translating linear movement of said piston toward the other of said first or second outer body ends into counterclockwise relative rotational movement between said shaft and said outer body to selectively rotate said work implement attachment head and hence the work implement about said body longitudinal axis independent of said boom attachment head and hence the boom arm, whereby the dipper stick assembly is capable of handling significantly increased loads without interfering with the operation of the linear-to-rotary transmission means such as can occur on misalignment.

38. The vehicle of claim 37, further including a first radial bearing disposed between said inward wall portion of said outer body and said outward wall portion of said inner body toward said first inner body end, and a second radial bearing disposed between said inward wall portion of said outer body and said outward wall portion of said inner body toward said second inner body end,

39. The vehicle of claim 37 wherein said shaft extends between said boom attachment head and said work implement attachment head, and retains said boom attachment head and said work implement head against separation along said body longitudinal axis.

40. The vehicle of claim 39 wherein said inner body and said shaft are rigidly attached to said boom attachment head and rotate as a unit with said boom attachment head through the boom plane upon actuation of the dipper stick actuator, and said outer body is rigidly attached to said work implement attachment head and rotates with said work implement attachment head through the dipper stick plane upon actuation of the work implement actuator, said outer body applying rotational drive to said work implement attachment head for selective rotation thereof in clockwise and counterclockwise directions about said body longitudinal axis independent of said boom attachment head upon selective application of fluid pressure to one or an other side of said piston.

41. The vehicle of claim 37 wherein said shaft has a central aperture extending longitudinally therethrough, and the dipper stick assembly further includes a tie rod extending longitudinally within said outer body in generally coaxial arrangement with said body and through said shaft central aperture, said tie rod extending between said boom attachment head and said work implement attachment head and retaining said boom attachment head and said work implement attachment head against separation along said body longitudinal axis.

42. The vehicle of claim 41 wherein said shaft extends from said boom attachment head to about said midportion of said outer body between said first and second outer body ends, and wherein said inner body and said shaft are rigidly attached to said boom attachment head and rotate as a unit with said boom attachment head through the boom plane upon actuation of the dipper stick actuator, and said outer body is rigidly attached to said work implement attachment head and rotates with said work implement attachment head through the dipper stick plane upon actuation of the work implement actuator, said outer body applying rotational drive to said work implement attachment head for selective rotation thereof in clockwise and counterclockwise directions about said body longitudinal axis independent of said boom attachment head upon selective application of fluid pressure to one or an other side of said piston.

43. A fluid-powered rotary dipper stick assembly attachable to a vehicle usable for excavation, the dipper stick assembly comprising:

a boom arm pivotally connected to the vehicle and pivotally moveable through a first plane containing said boom arm;

a dipper stick actuator associated with said boom arm and selectively operable to pivotally move said boom arm through said first plane;

a work implement;

a work implement actuator associated with said work implement and selectively operable to pivotally move said work implement through a second plane;

a boom attachment head having a first attachment portion attachable to the vehicle boom arm, and a second attachment portion attachable to the dipper stick actuator to provide pivotal movement of said boom attachment head through the boom plane upon actuation of the dipper stick actuator, said first attachment portion and said second attachment portion being selectively detachable from the boom arm and the dipper stick actuator;

a work implement attachment head having a third attachment portion attachable to the work implement to provide pivotal movement of the work implement through the dipper stick plane upon actuation of the work implement actuator, said third attachment portion being selectively detachable from the work implement;

an elongated, generally cylindrical outer body having a longitudinal axis and generally extending at least partially between said boom attachment head and said work implement attachment head with a first outer body end toward said boom attachment head and a second outer body end toward said work implement attachment head;

a shaft extending longitudinally within said outer body in general coaxial arrangement with said outer body, said shaft being rigidly attached to said boom attachment head, and said outer body being rigidly attached to said work implement attached head and having a fourth attachment portion spaced away from said work implement attachment head and attachable to the work implement actuator to apply a counterforce upon actuation of the work implement actuator to rotate the work implement in the dipper stick plane, said outer body and said shaft being selectively rotatable relative to each other about said outer body longitudinal axis;

an elongated generally cylindrical inner body disposed within said outer body with an outward wall portion thereof positioned immediately adjacent to an inward wall portion of said outer body, said inner body having first and second inner body ends and extending longitudinally within said outer body in generally coaxial arrangement therewith from said first inner body end positioned toward said first outer body end to said second inner body end positioned toward a midportion of said outer body between said first and second outer body ends, said inner body being in supporting sliding engagement toward both said first and second inner body ends with said inward wall portion of said outer body, said inner body being rigidly attached to said shaft toward said first inner body end, said outer body being selectively rotatable relative to said inner body and said shaft about said body longitudinal axis, said first and second inner body ends being spaced apart by a sufficient distance to provide increased stability against forces generated during use of the dipper stick assembly tending to move said outer body out of coaxial alignment with said shaft; and linear-to-rotary transmission means disposed within said outer body and operable for producing rotational movement of said shaft relative to said outer body, said transmission means including a piston for the selective application of fluid pressure to one or an other side thereof to produce linear movement of said piston within said outer body selectively toward said first and second outer body ends, and means for translating linear movement of said piston toward one of said first or second outer body ends into clockwise relative rotational movement between said shaft and said outer body and translating linear movement of said piston toward the other of said first or second outer body ends into counterclockwise relative rotational movement between said shaft and said outer body to selectively rotate said work implement attachment head and hence the work implement about said body longitudinal axis independent of said boom attachment head and hence the boom arm, whereby the dipper stick assembly is capable of handling significantly increased loads without interfering with the operation of the linear-to-rotary transmission means such as can occur on misalignment.

44. The rotary dipper stick assembly of claim 43 further including a first radial bearing disposed between said inward wall portion of said outer body and said outward wall portion of said inner body toward said first inner body end and a second radial bearing disposed between said inward wall portion of said outer body and said outward wall portion of said inner body toward said second inner body end.

45. The rotary dipper stick assembly of claim 43 wherein said shaft extends between said boom attachment head and said work implement attachment head, and retains said boom attachment head and said work implement head against separation along said body longitudinal axis.

46. The rotary dipper stick assembly of claim 43 wherein said inner body and said shaft are rigidly attached to said boom attachment head and rotate as a unit with said boom attachment head through the boom plane upon actuation of the dipper stick actuator, and said outer body is rigidly attached to said work implement attachment head and rotates with said work implement attachment head through the dipper stick plane upon actuation of the work implement actuator, said outer body applying rotational drive to said work implement attachment head for selective rotation thereof in clockwise and counterclockwise directions about said body longitudinal axis independent of said boom attachment head upon selective application of fluid pressure to one or an other side of said piston.

47. The rotary dipper stick assembly of claim 43 wherein said shaft has a central aperture extending longitudinally therethrough, and the dipper stick assembly further includes a tie rod extending longitudinally within said outer body in generally coaxial arrangement with said body and through said shaft central aperture, said tie rod extending between said boom attachment head and said work implement attachment head and retaining said boom attachment head and said work implement attachment head against separation along said body longitudinal axis.

48. The rotary dipper stick assembly of claim 47 wherein said shaft extends from said boom attachment head to about said midportion of said outer body between said first and second outer body ends, and wherein said inner body and said shaft are rigidly attached to said boom attachment head and rotate as a unit with said boom attachment head through the boom plane upon actuation of the dipper stick actuator, and said outer body is rigidly attached to said work implement attachment head and rotates with said work implement attachment head through the dipper stick plane upon actuation of the work implement actuator, said outer body applying rotational drive to said work implement attachment head for selective rotation thereof in clockwise and counterclockwise directions about said body longitudinal axis independent of said boom attachment head upon selective application of fluid pressure to one or an other side of said piston.

* * * * *

UNITED STATES PATENT AND TRADEMARK OFFICE

CERTIFICATE OF CORRECTION

PATENT NO. : 4,950,127

DATED : August 21, 1990

INVENTOR(S) : Paul P. Weyer

It is certified that error appears in the above-identified patent and that said Letters Patent is hereby corrected as shown below:

In claim 7, column 14, line 8, please delete "6" and substitute therefor --5--.

In claim 25, column 16, line 60, please delete "imp/element" and substitute therefor --implement--.

In claim 37, column 20, line 28, please delete "aid" and substitute therefor --said--.

Signed and Sealed this

Twelfth Day of November, 1991

*Attest:*

HARRY F. MANBECK, JR.

*Attesting Officer*

*Commissioner of Patents and Trademarks*